United States Patent [19]

Gorelik

[11] 4,218,796

[45] Aug. 26, 1980

[54] METHOD AND APPARATUS FOR THE EDGE TRIMMING OF SHOES, HABERDASHERY GOODS, ETC.

[76] Inventor: Lilian Gorelik, 2740 W. Granville Ave., Chicago, Ill. 60659

[21] Appl. No.: 953,083

[22] Filed: Oct. 20, 1978

[51] Int. Cl.[2] ..... A43D 43/06

[52] U.S. Cl. ..... 12/90

[58] Field of Search ..... 12/88, 90, 91

[56] References Cited

U.S. PATENT DOCUMENTS

| | | | |
|---|---|---|---|
| 1,271,638 | 7/1918 | Warren | 12/90 |
| 1,763,370 | 6/1930 | Rousseau | 12/90 |
| 1,832,994 | 11/1931 | Mileham | 12/88 |
| 3,257,675 | 6/1966 | Smith | 12/90 |

*Primary Examiner*—Patrick D. Lawson

*Attorney, Agent, or Firm*—Hill, Van Santen, Steadman, Chiara & Simpson

[57] ABSTRACT

An edge trimming cutting tool is rotated against the edge of a shoe sole while a guide shield member, spaced from the tool, moves peripherally of the shoe in the groove formed at the junction of the sole and the upper. The guide shield member may be fixed or freewheeling but does not rotate, at least not at the speed of the tool, so as to prevent the guide from damaging the upper as by cutting, burning or the like.

5 Claims, 3 Drawing Figures

METHOD AND APPARATUS FOR THE EDGE TRIMMING OF SHOES, HABERDASHERY GOODS, ETC.

BACKGROUND OF THE INVENTION

1. Field of the Invention

This invention relates to the manufactures of shoes and is more particularly concerned with a method of and apparatus for edge trimming the soles of shoes.

2. Description of the Prior Art

It is well known in the art to rotate an edge cutting trimming tool against the edge of the sole of a shoe to trim off excess sole material. A shield is fixed to and rotates with the tool, the purpose of the shield being to protect the upper from the tool. However, the rotating shield itself causes damage, e.g. cutting, burning, etc., to the upper, the shoe being guided by hand, and such damage has resulted in a reject rate of approximately 8%.

SUMMARY OF THE INVENTION

The primary object of the present invention, therefore, is to eliminate damage to the upper which has heretofore resulted from the tool shield.

According to the invention, the shield is used also as a guide and is mounted spaced from the trimming tool, preferably at a spacing of 0.1–0.33 mm. The guide shield does not rotate mutually with the tool, although it may rotate. The guide shield may therefore be fixed or free-wheeling.

The guide shield may be mounted separately from the tool, or it may be rotatable mounted to and axially of the tool.

BRIEF DESCRIPTION OF THE DRAWING

Other objects, features and advantages of the invention will be best understood from the followiing detailed description, taken in conjunction with the accompanying drawing, on which.

DESCRIPTION OF THE PREFERRED EMBODIMENTS

Figure 1:
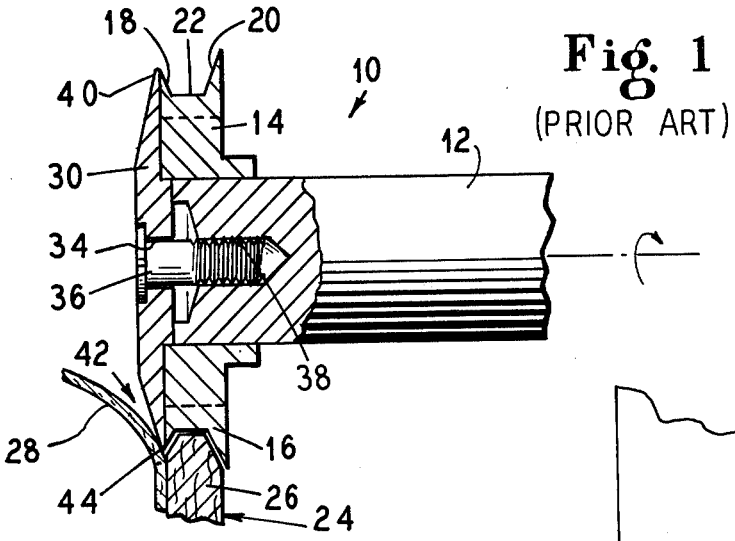
Fig. 1 (PRIOR ART)
FIG. 1 is a longitudinal sectional view of a prior art edge trimming apparatus.

Referring to FIG. 1 a prior art apparatus is generally illustrated at 10 as comprising a rotatable shaft 12 having an edge trimming tool 14 secured thereon for mutual rotation therewith. The attachment of the edge trimming tool 14 maybe by any suitable means, such as set screw, swedging or the like.

The edge trimming tool 14 includs a plurality of teeth 16 each of which has a plurality of cutting surfaces 18, 20 and 22 so that as the tool 14 is moved along the edge of a sole 26 of a shoe 24 a corresponding profile is produced. Of course, FIG. 1 is somewhat exaggerated with respect to the fragmentary showing of the shoe 24 and its relationship to the edge trimming tool 14.

In order to protect the upper 28 of the shoe 24 from the cutting tool 14, a shield is provided. As seen in FIG. 1, such a shield 30 includes an axial bore 35 through which a threaded, fastener extends and engages an axially threaded bore 38 of the shaft 12.

The shield 30 extends radially slightly beyond the teeth of the edge trimming tool so as to protect the upper 28 of the shoe 24 from the sharp edges of the tool. However, care must be taken by the operator that the shield 40 itself does not damage the upper, by cutting, burning or the like, as the outer teeth and edge 40 are guided throug a groove 42 which is formd at the junction of the upper 28 and the sole 26. As indicated at 44, the shield itself can damage the upper. In one shoe-making operation, the reject rate was found to be 8%.

Figure 2:
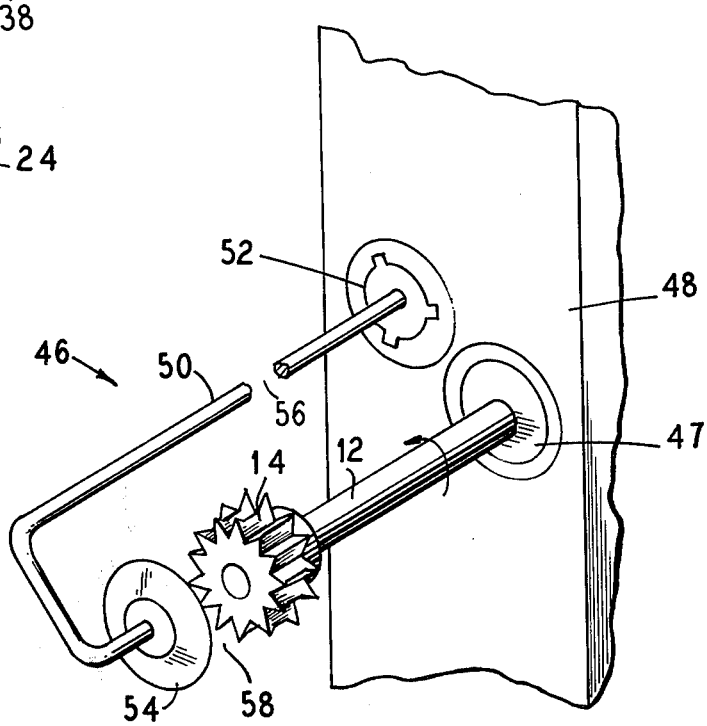
FIG. 2 is an isometric view of a first embodiment of the invention.

The present invention prevents damage to the upper of the shoe heretofore occasioned by the rotating shield, by providing that the shield be either affixed as a guide member, hereinafter referred to as a guide shield, or be a free-wheeling rotatable member. It should be mentioned at this point that the edge trimming tool generally rotates at a speed of 1400 rpm or 2800 rpm. The elimination of this high-speed rotation of the shield 30 is therefore of primary importance. In FIG. 2, an embodiment of the invention is generally illustrated at 46 as comprising the rotatable shaft 12 and the edge trimming tool 14 mounted for rotation in a bearing 47 carried by a frame member 48. The drive for the shaft 12 has been omitted for ease and clarity in illustrating the invention. In FIG. 2, an elongate, generally J-shaped member 50, is illustrated as having one end thereof fixed at 52 to the frame member 48 so as to extend beyond the end face of the edge trimming tool 14. The distal end of the member 50 carries a guide shield 54 which is either fixed against rotation or free-wheeling. The member 50 has been broken and moved further outwardly at 56 so as to exaggerate the spacing 58 between the guide shield 54 and the edge trimming tool 14. This spacing is preferably about 0.1 mm in this embodiment of the invention, the shoe maybe moved with the guide shield 54 in the groove formed between the sole and upper of the shoe and the non-rotation, or relatively minor rotation of the guide shield prevents damage heretofore caused by the shield, while at the same time protecting the upper from the rotating teeth of the edge trimming tool 14.

Figure 3:
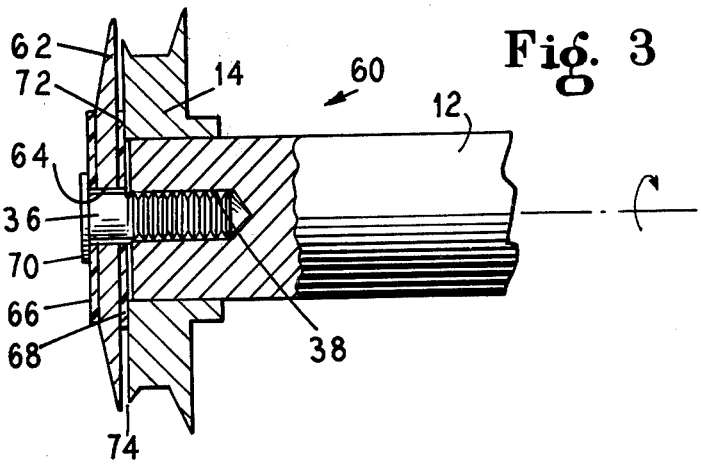
FIG. 3 is a longitudinal sectional view of another embodiment of the invention.

Another embodiment of the invention is generally illustrated at 60 in FIG. 3 as comprising the rotatable shaft 12 carry the edge trimming tool 14. In this embodiment of the invention, the guide shield 62 is provided with a central bore 64 which is larger than the elongate portion of the screw 36 so as to be rotatable thereabout. The screw 36, therefore forms a bearing for the guide shield 62. A pair of washers 66, 68 are disposed on each side of the guide shield 62 and the guide shield and the washers are clamped between the head 70 of the screw and the outer face 72 of the edge trimming tool 14. The washer 68 provides the desired spacing between the guide shield 62 and the edge trimming tool 14. This spacing is the same as that illustrated in exaggerated form at 58 in FIG. 2.

As an alternative, the screw 36 may have a flange thereon to provide the functions of the washer 68 and may include a threaded bore to receive a second screw to secure the washer 66 and the guide shield 62 against the flange.

Although I have described my invention by reference to particular illustrated embodiments thereof, many changes and modifications of the invention may become apparent to those skilled in the art without departing from the spirit and scope of the invention. I therefore intend to include within the patent warranted hereon all such changes and modifications as may reasonably improperly be included within the scope of my contribution to the art.

I claim:

1. Apparatus for trimming the edge of a sole of a shoe which is joined to the upper of the shoe comprising:

one-piece guide shield means to be received between the sole and the upper of the shoe at the joint therebetween;

a trimming tool mounted for rotation; and spacer means mounted coaxially with said guide shield means and said trimming tool and fixed with respect to said guide shield means for spacing said guide shield means from said trimming tool and providing that movement of the shoe, relative to said trimming tool and said guide shield means with said trimming tool against the edge of said sole and the guide shield means at the joint provides trimming of excess material from the shoe edge while protecting the upper of the shoe.

2. The apparatus of claim 1, wherein said spacer means includes a spacer having a thickness of 0.1 mm.

3. The apparatus of claim 1, comprising:

a rotatable shaft mounting said trimming tool;

an axially threaded bore in said shaft;

said guide shield means including an axial bore;

said spacer including an axial bore; and screw means including a head for clamping said guide shield means to said shaft and a threaded shank for extending through said bore of said spacer and said guide shield means to rotatably secure said guide relative means to said shaft.

4. Apparatus according to claim 1, comprising:

washer means;

a rotatable shaft carrying said trimming tool and including an axially threaded bore;

an axial bore in said spacer;

an axial bore in said guide shield means; and screw means, including head means, extending through said axial bores of said washer, said guide shield means and said spacer, and including a threaded shank threadingly engaging said threaded bore for securing said guide shield means to said shaft in a non-mutual rotational relationship with respect to said trimming tool.

5. Apparatus according to claim 3, wherein said screw means comprises a first screw including said threaded shank for engaging said threaded bore;

an axially threaded bore in said screw; and a second screw including a threaded shank for threadingly engaging said axial bore of said screw and a head for clamping said guide shield means in a non-mutual rotational relationship with respect to said trimming tool and said shaft.

* * * * *